US005674437A

United States Patent [19]

Geisel

[11] Patent Number: 5,674,437

[45] Date of Patent: Oct. 7, 1997

[54] METHOD OF PROVIDING LUMINESCENCE TO FIBROUS MATERIALS

[75] Inventor: Richard H. Geisel, Richmond, Va.

[73] Assignee: Glotex Corporation, Chapel Hill, N.C.

[21] Appl. No.: 608,411

[22] Filed: Feb. 28, 1996

[51] Int. Cl.[6] ..... C09K 11/00; D01F 1/10; D02G 3/36

[52] U.S. Cl. ..... 264/21; 264/103; 264/129; 264/171.13; 264/211; 427/393.5; 427/397.7

[58] Field of Search ..... 264/21, 103, 129, 264/168, 171.13, 211; 427/393.5, 397.7

[56] References Cited

U.S. PATENT DOCUMENTS

| | | |
|---|---|---|
| 2,787,558 | 4/1957 | Wadley . |
| 3,022,189 | 2/1962 | Malmquist . |
| 3,668,189 | 6/1972 | Goetz . |
| 4,211,813 | 7/1980 | Gravisse et al. . |
| 4,781,647 | 11/1988 | Doane, Jr. . |
| 4,943,896 | 7/1990 | Johnson . |
| 5,045,706 | 9/1991 | Tanaka et al. . |
| 5,135,591 | 8/1992 | Vockel, Jr. et al. . |
| 5,223,330 | 6/1993 | Vockel, Jr. et al. . |
| 5,321,069 | 6/1994 | Owens . |
| 5,424,006 | 6/1995 | Murayama et al. . |

FOREIGN PATENT DOCUMENTS

| | | | |
|---|---|---|---|
| 1-229804 | 9/1989 | Japan | 264/21 |

*Primary Examiner*—Leo B. Tentoni
*Attorney, Agent, or Firm*—Bell, Seltzer, Park and Gibson, P.A.

[57] ABSTRACT

A method for providing luminescence to fibrous material is provided. The method includes combining a metal aluminate oxide pigment with a thermoplastic polymer, and then heating, mixing, and extruding the combination into a fiber. A luminescent fiber comprising a thermoplastic polymer and metal aluminate oxide pigment, and articles of manufacture comprising such fibers are also provided.

21 Claims, 1 Drawing Sheet

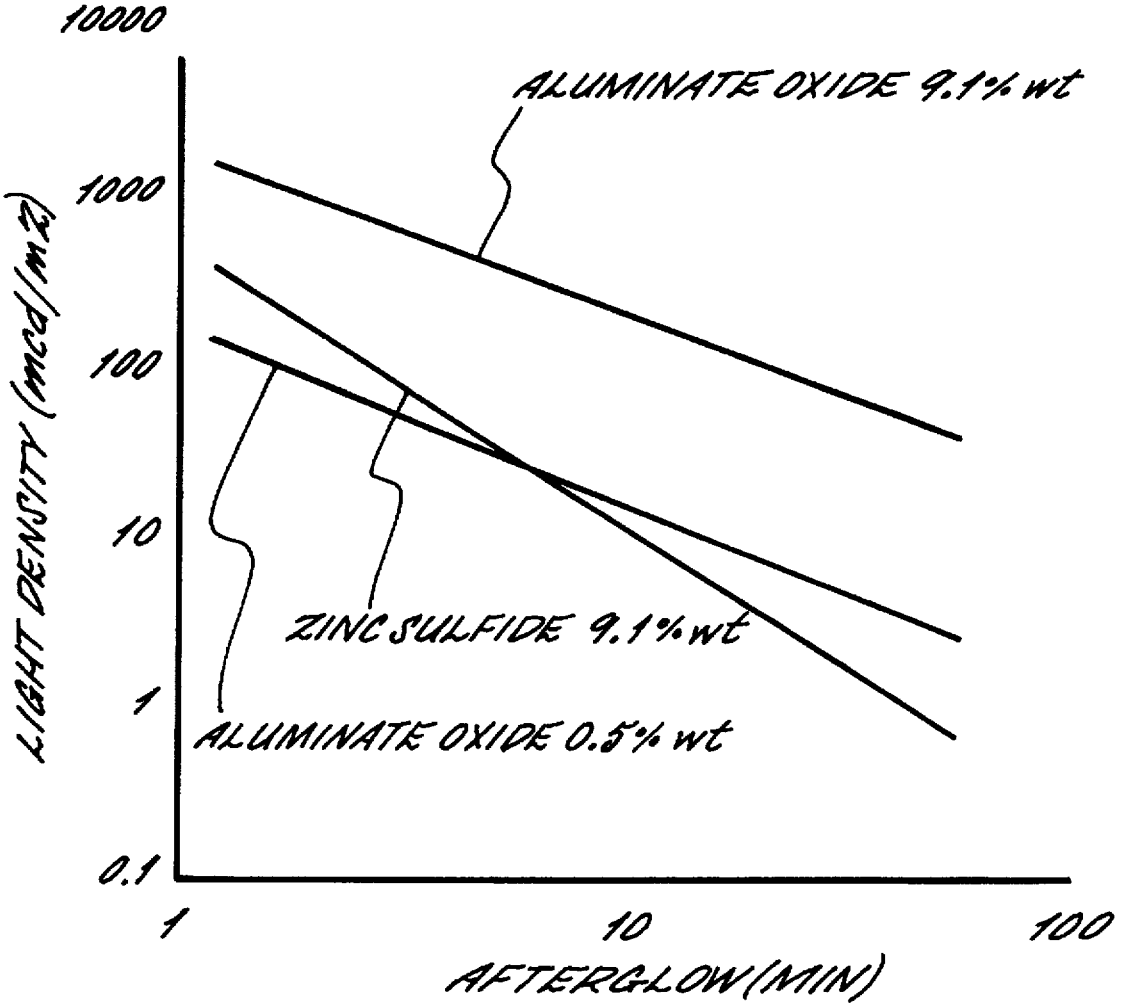
10000
1000
100
10
1
0.1
LIGHT DENSITY (mcd/m2)
ALUMINATE OXIDE 9.1% wt
ZINC SULFIDE 9.1% wt
ALUMINATE OXIDE 0.5% wt
1
10
100
AFTERGLOW (MIN)

METHOD OF PROVIDING LUMINESCENCE TO FIBROUS MATERIALS

The present invention relates to a method for providing luminescence to a fibrous material. Luminescent fibrous materials and articles of manufacture comprising luminescent fibrous material are also provided.

BACKGROUND OF THE INVENTION

There are various recognized means for providing fibers and filaments having luminescent properties, most of which utilize zinc sulfide or a related compound as the luminescent agent or pigment. For example, U.S. Pat. No. 2,787,558 to Wadely proposes a process for making phosphorescent yarn in which spun yarn-stock is impregnated with a solution consisting essentially of zinc sulfide, a casein solution, polyvinyl acetate, and water. Other phosphorescent pigments described by this patent include zinc sulfide combined with cadmium sulfide, or cadmium sulfide combined with strontium sulfide.

U.S. Pat. No. 5,321,069 to Owens proposes a thermoplastic polymeric material (e.g., polypropylene) mixed with a powdered phosphorescent pigment in pellet form and a wetting agent, which mixture is then melted and extruded to form phosphorescent textile filaments, yarns, tapes or films having uniform phosphorescent properties. This patent also recites the use of zinc sulfide as the phosphorescent pigment.

U.S. Pat. No. 4,781,647 to Doane proposes a toy doll in which the hair of the doll is composed of synthetic phosphorescent fiber, and further proposes a method of making such a fiber. The fiber has cross-sectional dimensions of less than 0.015 inches, and is made by extruding flexible polymeric material that contain phosphorescent particles, which particles have a maximum size of 0.0075 inches and are smaller than one-half of the cross-sectional dimension of the fiber. Doane also recites the use of zinc sulfide, cadmium sulfide, and calcium sulfide as phosphorescent pigments useful in this invention.

U.S. Pat. No. 4,943,896 to Johnson proposes a method of producing infant care articles having at least one component formed of a plastic material by molding or extrusion, such that the component has the property of phosphorescent emission of light. The phosphorescent plastic component is produced by mixing the plastic material with a non-toxic, non-irritating phosphorescent pigment prior to extrusion. Dependent claims are also directed to the use of the proposed method to make phosphorescent monofilament and polyfilament threads. The choice of phosphorescent pigment is limited in that the thermal decomposition point of the pigment must be above the melting point of the plastic material, and the pigment must not be subject to chemical degradation by the plastic material. Again, this patent recites the use of zinc sulfide as the phosphorescent pigment.

U.S. Pat. Nos. 5,135,591 and 5,223,330 to Vockel et al., 4,211,813 to Gravisse, and 3,022,189 to Malmquist relate to fibers that have luminescent properties wherein the fiber materials are coated with phosphorescent materials or pigments, rather than have phosphorescent materials incorporated into the fiber material. U.S. Pat. Nos. 3,668,189 to Goetz and 5,045,706 to Tanaka et al. describe textile materials with fluorescent properties. In both the Goetz and Tanaka patents, the fluorescent property is imparted to the fiber or fabric by an organic fluorescent substance (e.g., piperidinium tetrabenzoyltrifluroacetate or benzanthracene). Fluorescence is a special form of luminescence in which an atom or molecule emits visible radiation in passing from a higher to a lower electronic state; the term "fluorescence" is restricted to phenomena in which the time interval between absorption and emission of energy is extremely short ($10^{-8}$ to $10^{-3}$ seconds). See R. J. Lewis, *Hawley's Condensed Chemical Dictionary* (Twelfth Edition, 1993).

Despite the general availability of pigments such as zinc sulfide that are useful in providing luminescence to fibrous materials, there continues to be a desire for improvements that overcome some of the difficulties and disadvantages of using pigments known in the prior art. One such disadvantage is that often a relatively large amount of pigment such as zinc sulfide is needed to provide a satisfactory amount of luminescence to a fibrous material, due to both the large particle size of zinc sulfide and its luminescent nature. For example, the Owens '069 patent indicates that when powdered, solid zinc sulfide with a mean particle range of about 30 microns is used to provide luminescence to spun yarn, a weight percentage of over 2.5% was required to produce the desired amount of phosphorescence. Furthermore, Owens '609 requires a wetting agent in order to assure a uniform distribution of pigment throughout the polymer.

There is also a continuing desire for a process which enhances both the intensity of the luminescence exhibited by the luminescent fiber (light density) and the length of time for which the fiber is luminescent (light fastness or afterglow). The desire to produce brighter and more long-lasting luminescence to fibrous material is especially strong with reference to the production of safety-oriented clothing and equipment.

It is therefore an object of the present invention to provide an improved method for providing luminescence to fibrous materials, and particularly to provide a method which provides one or more particularly advantageous results, including increased light intensity, decreased specific gravity, duration of luminescence, and the need to use less luminescent material in order to produce the desired effects.

SUMMARY OF THE INVENTION

This invention relates to a method for providing luminescence to a fibrous material which includes the steps of combining a thermoplastic polymer with a metal aluminate oxide pigment in an extruder, and melting, mixing and extruding the combination to form a fiber. The use of the present method results in a luminescent fiber with afterglow and brightness characteristics superior to those produced by methods in the existing art.

This invention further relates to a luminescent extruded fiber comprising 80% to 99% by weight of the extruded fiber of a thermoplastic polymer, 0.05% to 5% by weight of the extruded fiber of a metal aluminate oxide pigment, and 0.5% to 5% by weight of the extruded fiber of a plasticizer. This fiber is useful in the manufacture of various textile and household goods, and has afterglow and brightness characteristics superior to those known in the prior art.

BRIEF DESCRIPTION OF THE DRAWING

FIG. 1 graphically demonstrates a comparison in afterglow characteristics and light density between luminescent fibers containing either zinc sulfide or a metal aluminate oxide pigment, as detailed in Example 1.

DETAILED DESCRIPTION OF THE INVENTION

As summarized above, the present invention provides an improved method of providing luminescence to fibrous materials. The method is particularly adapted for the production of fibers or yarns useful in textile manufacture, and especially in the manufacture of consumer goods such as clothing, sporting equipment, toys, and household items.

The method of the present invention can advantageously be employed using customary melt-spin extrusion techniques, which are known to those skilled in the art. The method is typically carried out by combining a thermoplastic polymer with a metal aluminate oxide pigment. These elements are combined in an extruder, with the mixture then being heated to form a melt; mixed; and extruded to form a fiber. After extrusion, the filament can be coated with a coating agent. When exposed to an ultraviolet (UV) or visible light source, the fiber or filament is thus able to retain and shed light (i.e. glow or luminesce) after the light source is removed.

In an alternative embodiment of the invention, the luminescent pigment is not combined prior to extrusion with the thermoplastic polymer, but instead is coated onto the surface of the extruded fiber.

In accordance with the present invention, examples of fibrous textile material, include, but are not limited to, fibers, monofilaments, paper, ribbon, lace, webs, yarns, threads, multifilament threads, batts, staple fibers, slivers, woven fabrics, knitted fabrics, non-woven fabrics, and the like.

Any synthetic thermoplastic polymer may be used to produce the luminescent fibrous material, including polypropylene, aliphatic polyamides (e.g., nylon) polyesters, polymethacrylics, polyacrylates, polycarbonates, polycyanoethylenes, polyacrylonitrides, polyvinyl chloride, polyethylene, polystyrene, polyurethane, acrylate resins, halogenated polymers, and mixtures and blends thereof. Polypropylene is a particularly preferred polymer.

The thermoplastic polymer is preferably in solid, pellet form, but may also be in the form of flakes, films, membranes, resins, foams, sheets, granules and powders. The polymer preferably comprises from 80% to 99% by weight of the extruded fiber, and preferably from 85% to 95% by weight.

For the purposes of this invention, the term "metal aluminate oxide pigment" refers to a luminescent pigment expressed by $MAl_2O_4$, in which M is at least one metal element selected from the group consisting of calcium, strontium, and barium, and which further contains one activator and an additional co-activator doped therein. Alternatively, the metal aluminate oxide pigment is expressed by $MAl_2O_4$, in which M is plural metal elements which are composed of magnesium and at least one metal element selected from the group consisting of calcium, strontium and barium, and which further contains an activator and a co-activator doped therein. The first activator is preferably europium, and the co-activator may be an element selected from the group consisting of lanthanum, cerium, praseodymium, neodymium, samarium, gadolinum, dysprysium, holmium, erbium, thulium, ytterbium, lutetium, tin and bismuth.

In a preferred embodiment of the invention, the pigment used in the production of the luminescent fiber is a phosphorescent phosphor available commercially as LUMINOVA® (United Mineral Corporation, New Jersey, USA). This pigment is described in U.S. Pat. No. 5,424,006 to Murayama et al., the disclosure of which is incorporated herein by reference in its entirety. The pigment preferably comprises from 0.05% to 5% by weight of the extruded fiber, and more preferably from 0.25% to 1% by weight of the extruded fiber.

Additionally, a plasticizer may added to the extruded mixture to enhance flexibility, stability, and uniformity in the fibrous material. Examples of preferred plasticizers include polyoxyethylene, sorbitan tristearate, dibutyl phthalate and dioctyl phthalate. The selection of other plasticizers will be within the skill of one in the art. Preferably, the concentration of plasticizer is from 0.5% to 5% by weight of the extruded fiber.

Other additives and auxiliaries may be added to the combination of polymer and pigment, such as softeners, levelling agents, antistatic agents, water repellents, anti-foaming agents, oil-repellant resins, softeners, IR absorbers, bactericides, fungicides, anti-viral agents or the like. Examples of water repellents are aluminum-containing or zirconium-containing paraffin wax emulsions, and silicon-containing formulations. Examples of softeners are oxyethylation products of higher fatty acids, fatty alcohols, or fatty acid amides, N-stearyl-urea compounds and stearylamidomethylpyridinium. Examples of levelling agents include water-soluble salts of acidic esters obtained from polybasic acids and ethylene oxide or propylene oxide adducts of relatively long-chain base molecules capable of undergoing oxyalkylation. Preferred additives useful in the present invention are phosphites, acid neutralizers, hindered amine light stabilizers, and antioxidants. It is preferred that the total amount of additional additive is present in an amount of from 0.5 to 10% by weight of the dry, extruded fiber. Alternatively, these and other additives may be applied as a post-extrusion finish.

The temperature at which the mixture to be extruded is melted will vary, according to the particular thermoplastic polymer being used, and its melting temperature. For example, if polypropylene resin is used (melting point of about 165° C.), the melting step of the method of the present invention will occur at a temperature above 165° C. Melting of the extrusion mixture at temperatures typical of thermoplastic resins will not adversely affect the luminescent pigment, as the melting point of aluminate oxide is about 2000° C. Specific extrusion techniques are within the skill of one in the art.

After the extrusion mixture is combined, melted, and extruded, the resulting fibrous material is coated with an appropriate coating agent to isolate the fiber from undesired effects of the environment. The coating is applied by various coating methods, including roller coating, reverse roller coating, blade coating, knife coating, dip coating, kiss roll coating, spray coating, electrodeposition, or by paint brush or hand rolling. Preferred coating agents include, but are not limited to, the following: silica, polyalkylene glycols, polyalkylene glycol esters, polyalkylene glycol alcohols, quartenary amines, alcohol phosphate salts, long chain fatty acid esters, and long chain fatty alcohol esters. A coating agent may be used individually, or may be combined with one or more other coating agents in order to encapsulate the extruded fiber. The pH of the coating may be adjusted with amines such as triethanol amine or morpholine and the like, or aqueous ammonia solution. The amount of coating agent used will preferably range from about 0.5% to about 5.0% by weight of the extruded and coated fiber.

In view of the desirable results achieved to date, it is thought that the use of the method of the present invention is applicable in combination with a wide variety of other luminescent and non-luminescent pigments. These pigments include, but are not limited to, Hansa Yellow, phthalocyanine blue and green, quinacridones such as Red B, Red Y, Violet R, and Orange RK; also Cadmium Red, Chrome Yellow, Molybdate Orange, Ferric Oxide, Carbon Black, zinc sulfide, cadmium sulfide, calcium sulfide, and metallic pigments such as aluminum, bronze, and stainless steel flake. Extender pigments include calcium carbonate, calcium silicate, mica, clay, silica, barium sulfate and the like.

The extruded fiber may be extruded into various deniers, brightness levels and afterglow strengths, based upon the specifications of the desired final product. The manufactured fiber may then be used for weaving, fleecing, plush work, sliver knit, stitching, embroidery, tufting, and the like. The method of the present invention is particularly useful in the production of microdenier (<1 denier) fiber materials.

The methods of the present invention may be used to produce luminescent fibrous material for various articles of manufacture, including rope, string, nets, tents, awnings, tarpaulins, sails and bags, yarns and threads for textile use, textiles and textile goods, bedding and table cloths, clothing, footwear, headgear, lace and embroidery, ribbons and braid, carpets, rugs, mats and matting, toys, games, sporting articles, and the like.

Additional benefits and advantages of the invention will be apparent from the following illustrative example. In the following example, the abbreviation mcd/m$^2$ means millicandelas per meter-squared.

EXAMPLE 1

Extruded fibers comprising polypropylene resin, and either metal aluminate oxide pigment or zinc sulfide as a luminescence-providing pigment are produced by standard melt-spin extrusion process known in the art. The concentrations of the pigments are varied in order to compare the relative brightness and afterglow properties of fibers containing the two different pigments.

The results of this comparison are shown in FIG. 1. A fiber comprising 9.1% by weight of metal aluminate oxide pigment exhibits a light density of over 1000 mcd/m$^2$ after one minute, whereas the fiber comprising 9.1% by weight of zinc sulfide has an light density of approximately 500 mcd/m$^2$. After approximately 80 minutes, the light density of the metal aluminate oxide pigment fiber decreases to approximately 100 mcd/m$^2$, while the light density of the zinc sulfide fiber decreases to less than 1 mcd/m$^2$.

When metal aluminate oxide pigment is used as 0.5% by weight, its afterglow value is still greater than zinc sulfide. After one minute, the light density of the metal aluminate oxide pigment fiber is slightly more than 100 mcd/m$^2$. After approximately 80 minutes, however, the light density is approximately 3 mcd/m$^2$, significantly higher than zinc sulfide at a higher weight percentage.

In the specification and example, there have been disclosed preferred embodiments of the invention. Although specific terms are employed in these examples, they are used in a generic and descriptive sense only and not for the purpose of limitation, the scope of the invention being defined by the following claims.

That which is claimed is:

1. A method of providing luminescence to a fiber comprising the steps of:

combining in an extruder a thermoplastic polymer with a metal aluminate oxide pigment, the pigment being added in an amount sufficient to provide luminescence to the polymer after exposure to a light source;

heating and mixing the combination of thermoplastic polymer and pigment at a temperature sufficient to melt the thermoplastic polymer; and extruding the melted combination to form a fiber.

2. A method according to claim 1, wherein said extrusion step comprises simultaneously melt spinning a plurality of fiber to form a spun yarn.

3. A method according to claim 2, wherein the yarn is a bulked continuous fiber yarn.

4. A method according to claim 1, wherein said combining step further comprises adding an additional additive to the thermoplastic polymer and pigment, the additional additive selected from the group consisting of plasticizers, softeners, levelling agents, water repellents, anti-foaming agents, oil-repellant resins, softeners, IR absorbers, antistatic agents, bactericides, fungicides, anti-viral agents, phosphites, acid neutralizers, hindered amine light stabilizers, antioxidants, and luminescent and non-luminescent pigments.

5. A method according to claim 1 wherein the thermoplastic polymer is selected from the group consisting of polypropylene, aliphatic polyamides, polyesters, polymethacrylics, polyacrylates, polycarbonates, polycyanoethylenes, polyacrylonitrides, polyvinyl chloride, polyethylene, polystyrene, polyurethane, acrylate resins, halogenated polymers, and mixtures and blends thereof.

6. A method according to claim 1 wherein the thermoplastic polymer is polypropylene.

7. A method according to claim 6 wherein the polypropylene is in pellet form.

8. A method according to claim 1 wherein the fiber is coated with a coating agent after extrusion.

9. A method according to claim 1 wherein the percentage by weight of metal aluminate oxide pigment is from 0.05% to 5%.

10. A method according to claim 1 wherein the percentage by weight of metal aluminate oxide pigment is from 0.1% to 0.5%.

11. A method according to claim 1, wherein the mean particle size of the metal aluminate oxide pigment is from 12 to 21 microns.

12. A method of providing luminescence to a fiber comprising the steps of:

combining in an extruder a thermoplastic polymer and a plasticizer with metal aluminate oxide pigment, the pigment comprising 0.05% to 5% of the total combination by weight;

heating and mixing the combination of thermoplastic polymer, pigment and plasticizer at a temperature sufficient to melt the thermoplastic polymer;

extruding the melted combination to form a fiber, the fiber having a denier from about 0.1 to 250; and coating the fiber with a coating agent.

13. A method according to claim 12, wherein said extrusion step comprises simultaneously melt spinning a plurality of fiber to form a spun yarn.

14. A method according to claim 13, wherein the yarn is a bulked continuous fiber yarn.

15. A method according to claim 12, wherein said combining step further comprises adding an additional additive to the thermoplastic polymer and pigment, the additional additive selected from the group consisting of plasticizers, softeners, levelling agents, water repellents, anti-foaming agents, oil-repellant resins, softeners, IR absorbers, antistatic agents, bactericides, fungicides, anti-viral agents, phosphites, acid neutralizers, hindered amine light stabilizers, antioxidants, and luminescent and non-luminescent pigments.

16. A method according to claim 12 wherein the thermoplastic polymer is selected from the group consisting of polypropylene, aliphatic polyamides, polyesters, polymethacrylics, polyacrylates, polycarbonates, polycyanoethylenes, polyacrylonitrides, polyvinyl chloride, polyethylene, polystyrene, polyurethane, acrylate resins, halogenated polymers, and mixtures and blends thereof.

17. A method according to claim 12 wherein the thermoplastic polymer is polypropylene.

18. A method according to claim 17 wherein the polypropylene is in pellet form.

19. A method according to claim 12 wherein the coating agent is selected from the group consisting of silica, polyalkylene glycols, polyalkylene glycol esters, polyalkylene glycol alcohols, quartenary amines, alcohol phosphate salts, long chain fatty acid esters, and long chain fatty alcohol esters.

20. A method according to claim 12 wherein the percentage by weight of metal aluminate oxide pigment is from 0.1% to 0.5%.

21. A method according to claim 12 wherein the mean particle size of the metal aluminate oxide pigment is from 12 to 21 microns.

* * * * *